US005560414A

United States Patent [19]

Judkins et al.

[11] Patent Number: 5,560,414

[45] Date of Patent: Oct. 1, 1996

[54] RELEASABLE OPERATING CORD CONNECTOR FOR A WINDOW COVERING

[75] Inventors: Ren Judkins; Nick L. Ross, both of Pittsburgh, Pa.

[73] Assignee: Springs Window Fashions Division, Inc., Middleton, Wis.

[21] Appl. No.: 386,102

[22] Filed: Feb. 9, 1995

[51] Int. Cl.[6] ..... E06B 9/38

[52] U.S. Cl. ..... 160/178.1; 16/122; 24/115 F

[58] Field of Search ..... 160/178.1 R, 173 R; 24/115 F, 114.5, 128; 16/121, 122, 216, 217, 218

[56] References Cited

U.S. PATENT DOCUMENTS

| | | | |
|---|---|---|---|
| 1,682,994 | 9/1928 | Simon | 24/115 F |
| 4,909,298 | 3/1990 | Langhart et al. . | |
| 4,967,824 | 11/1990 | Colson et al. . | |
| 5,058,650 | 10/1991 | Morris . | |

*Primary Examiner*—Blair Johnson
*Attorney, Agent, or Firm*—Vernon J. Pillote

[57] ABSTRACT

A cord connector for releasably connecting multiple operating cords for a window covering. The cord connector has at least two side members supported for pivotal movement relative to each other between a closed condition in which the side members are in sidewise adjacent relation and an open condition in which at least upper portions of the side members are laterally spaced apart. Jaws on side members provide downwardly facing shoulders for engaging cord stops on the operating cords and the jaws have jaw edges operative when the side members are in the closed condition for laterally confining portions of the operating cords superjacent the stops to positions in which the cord stops engage the downwardly facing shoulders. The side members have lateral cord abutment portions spaced above the cord retaining means and arranged to form segments of a closed cord abutment loop dimensioned to loosely surround the operating cords at the upper end of the cord connector when the side members are in the closed condition. The jaws are operative when the side members are in the open condition to release lateral confinement of the operating cords superjacent the cord stops and allow movement of the operating cords and the cord stops thereon independent of the connector means and independent of each other.

31 Claims, 4 Drawing Sheets

FIG. 5
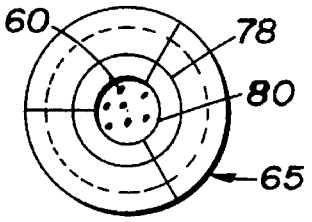
FIG. 6
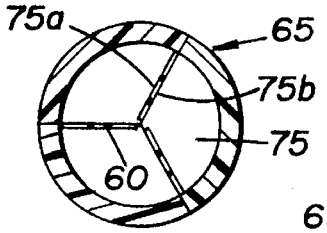
FIG. 9
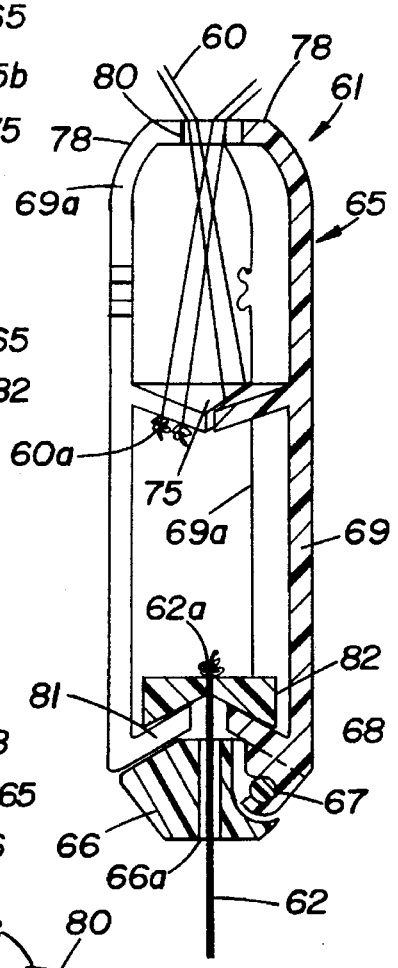
FIG. 4
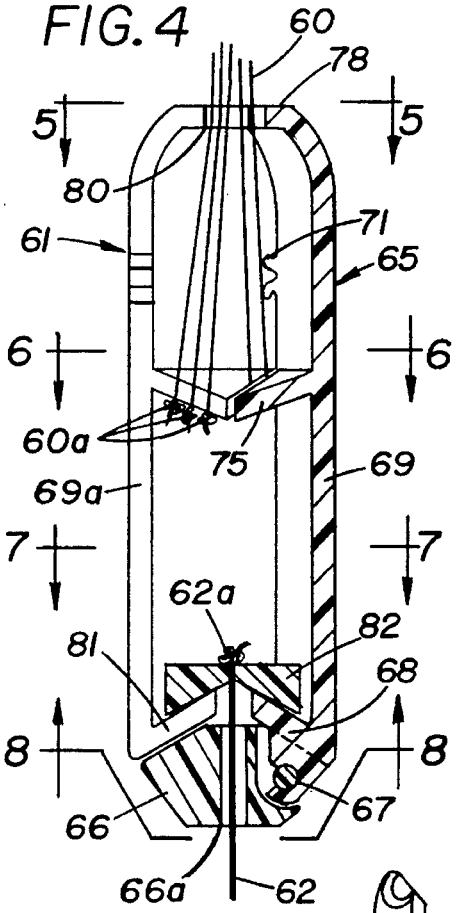
FIG. 7
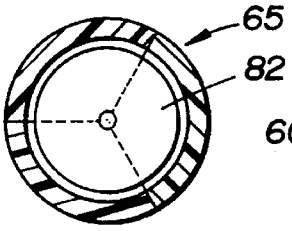
FIG. 8
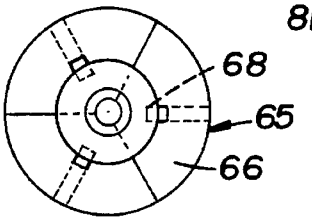
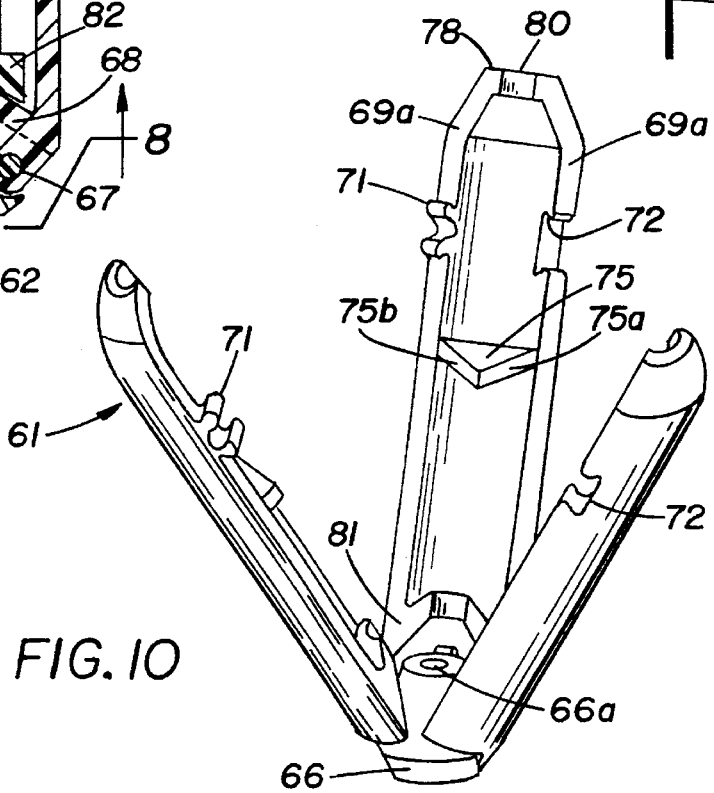
FIG. 10

FIG. 13
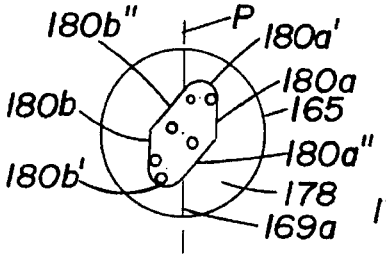
FIG. 14
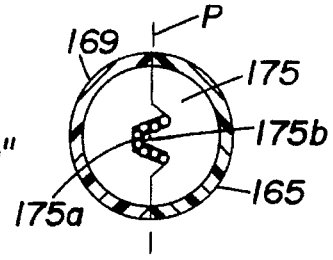
FIG. 15
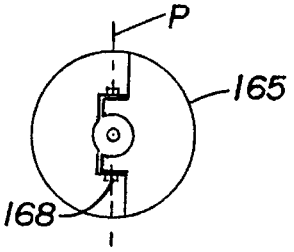
FIG. 11
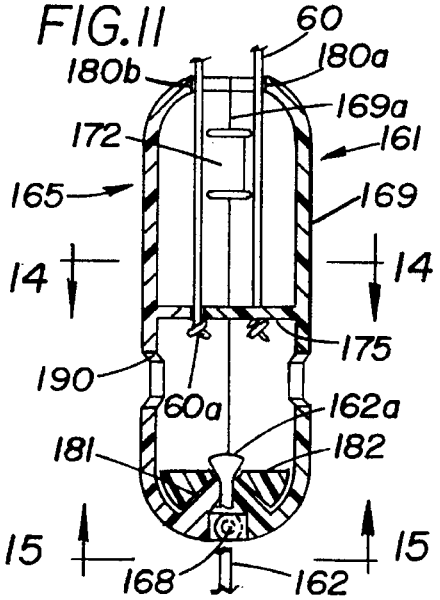
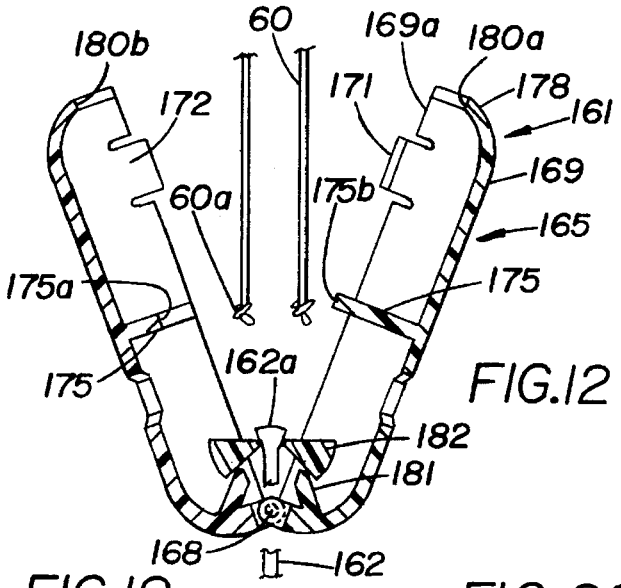
FIG. 12
FIG. 18
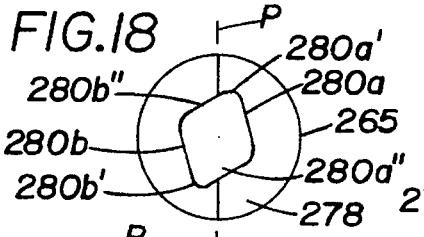
FIG. 19
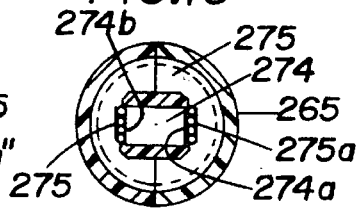
FIG. 20
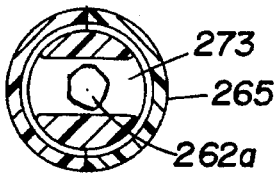
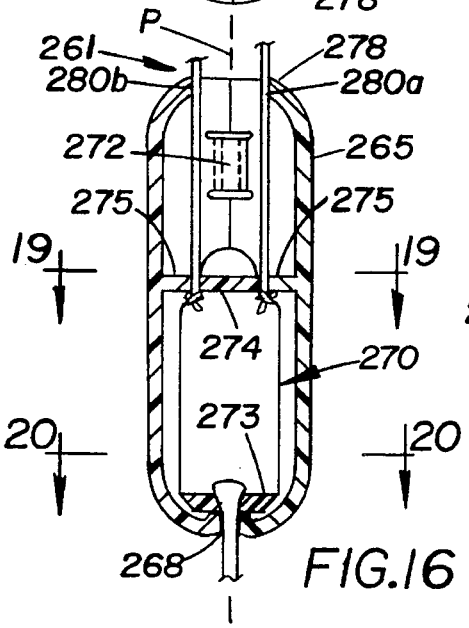
FIG. 16
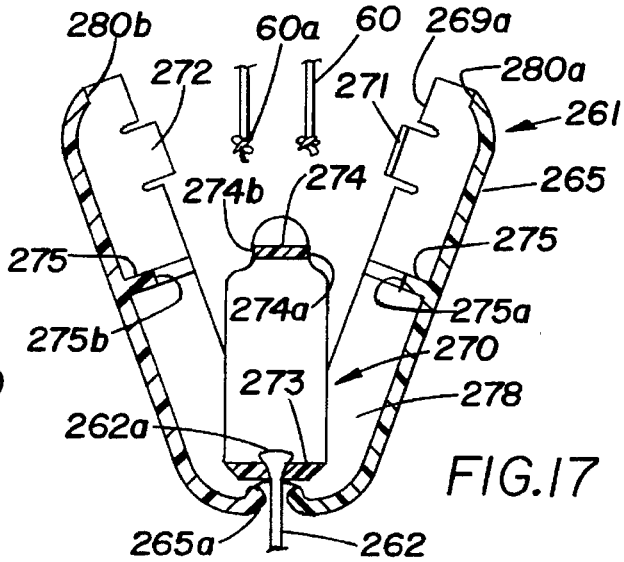
FIG. 17

RELEASABLE OPERATING CORD CONNECTOR FOR A WINDOW COVERING

BACKGROUND OF THE INVENTION

Many window coverings such as venetian blinds, pleated shades and cellular shades use two or more lift cords, and in some installations up to eight cords. The lift cords are connected at one end to the bottom rail and pass upwardly through the shade to the headrail and then lengthwise along the headrail and through a cord lock with operating cord portions that extend downwardly as a group from the headrail. In order to maintain the bottom rail horizontal when raising and lowering the curtain, it is necessary to equalize movement of the operating cord portions of the lift cords. In some installations, the multiple operating cords are tied together in a knot to equalize movement of the operating cords with a cord pull provided to cover the knot. In some other installations for example as shown in U.S. Pat. Nos. 4,967,824 and 5,058,650, the multiple operating cords are connected together by a cord equalizer that firmly grips the operating cords to equalize movement and a cord pull is attached to the operating cords at a location below the cord equalizer. As disclosed in the above patents, the user may grasp the operating cords directly or grasp the tassel affixed to the ends of the operating cords, or grasp the cord equalizer to raise and lower the blind.

Problems have been encountered when infants or children play with the operating cords and tassels and get a limb or their head introduced or entangled between some of the operating cords. When the multiple operating cords are permanently interconnected as by a cord equalizer or a cord tassel, the cords can function as noose that in some instances has caused injury and even death of a child.

It has heretofore been proposed and disclosed in U.S. Pat. No. 4,909,298 to provide a cord tassel for a window covering having two operating cords, in which the cord tassel consists of two members that are retained on the lower ends of the operating cords and in which the members are detachably connected to each other to enable separation of the lower ends of the two operating cords. Many window covering installations have more that two operating cords and sometimes up to eight operating cords and this markedly complicates the problem of releasably connecting the cords. More particularly, when multiple operating cords are used, the child might become entangled between different cords or different groups of cords.

SUMMARY OF THE INVENTION

It is an object of the present invention to provide a cord connector device for releasably connecting a plurality of operating cords in a window covering which cord connector normally connects the operating cords for movement in unison and which is arranged to release the operating cords from the cord connector and from each other in response to lateral separating forces between the operating cords in an area adjacent the cord connector.

Accordingly, the present invention provides a cord connector having upper and lower ends and at least two side members with means supporting the side members for movement relative to each other between a closed condition in which at least upper portions of the side members are in sidewise adjacent relation and an open condition in which at least the upper portions of the side members are laterally spaced apart, and means for releasably holding the upper portions of the side members in a closed condition. The cord connector has means for releasably retaining the operating cords, the cord retaining means including means providing downwardly facing shoulders for engaging cord stops on the operating cords and means operative when the side members are in the closed condition for laterally confining portions of the operating cords superjacent the cord stops to positions in which the cord stops engage the downwardly facing shoulders, the cord retaining means being operative when the side members are in an open condition to release lateral confinement of the portions of the operating cords and allow movement of the operating cords independent of the cord connector and independent of each other. The means for holding the upper portions of the side members in closed condition are constructed and arranged to release and allow the side members to move to the open condition in response to forces applied by the operating cords on the upper end of the cord connector in a direction laterally outwardly of upper ends of the side members.

The side members are preferably supported for pivotal movement relative to each other about axes spaced below the cord retaining means and transverse to the lift cords between the closed condition and the open condition so that only the upper portions of side members separate and the side members remain connected to each other in the open condition. The side members are also preferably provided with lateral cord abutment portions spaced above the cord retaining means and arranged to form segments of a closed loop dimensioned to loosely surround and detect lateral movement of the operating cords adjacent the upper end of the cord connector. Separating the means on the cord connector that detects lateral motion of the lift cords and actuates the side members to an open condition from the means for releasably retaining the operating cords on the cord connector, improves the reliability of performance of both of these functions. With this arrangement, the cord retaining means on the cord connector device are subjected primarily to the components of the tensile forces in the operating cords that generally parallel a cord path extending between the cord retaining means and the cord loop, and the lateral cord abutments that form the cord loop, are subjected primarily to the components of the tensile forces in the operating cords that are directed laterally outwardly of that cord path. Further, the space between the lateral cord abutment portions and the cord retaining means, allows twists and tangles in the operating cords to accumulate in this space without tightening to the point of binding the operating cords together.

BRIEF DESCRIPTION OF THE DRAWINGS

FIG. 4 is a fragmentary longitudinal sectional view illustrating one embodiment of the operating cord connector;

FIG. 5 is a top view taken on the plane 5—5 of FIG. 4;

FIG. 6 is a transverse sectional view taken on the plane 6—6 of FIG. 4;

FIG. 7 is a transverse sectional view taken on the plane 7—7 of FIG. 4;

FIG. 8 is a bottom view taken on the plane 8—8 of FIG. 4;

FIG. 9 is a longitudinal sectional view of the cord connector of FIG. 4, and diagrammatically illustrating operating cords tensioned in relative opposite directions;

FIG. 10 is a perspective view illustrating the cord connector of FIG. 4 in an open condition;

FIG. 11 is a longitudinal sectional view through a second embodiment of the cord connector in a closed condition.

FIG. 12 is a longitudinal section view through the cord connector of FIG. 11 illustrating the cord connector in an open condition;

FIG. 13 is a top view of the cord connector of FIG. 11;

FIG. 14 is a transverse sectional view taken on the plane 14—14 of FIG. 11;

FIG. 15 is a bottom view of the cord connector of FIG. 11 taken on the plane 15—15 of FIG. 11;

FIG. 16 is a longitudinal section view through a third embodiment of the cord connector in a closed condition;

FIG. 17 is a longitudinal sectional view illustrating the cord connector of FIG. 16 in an open condition;

FIG. 18 is a top view of the cord connector of FIG. 16;

FIG. 19 is a transverse sectional view taken on the plane 19—19 of FIG. 16;

FIG. 20 is a transverse sectional view taken on the plane 20—20 of FIG. 16;

DETAILED DESCRIPTION

Figure 1:
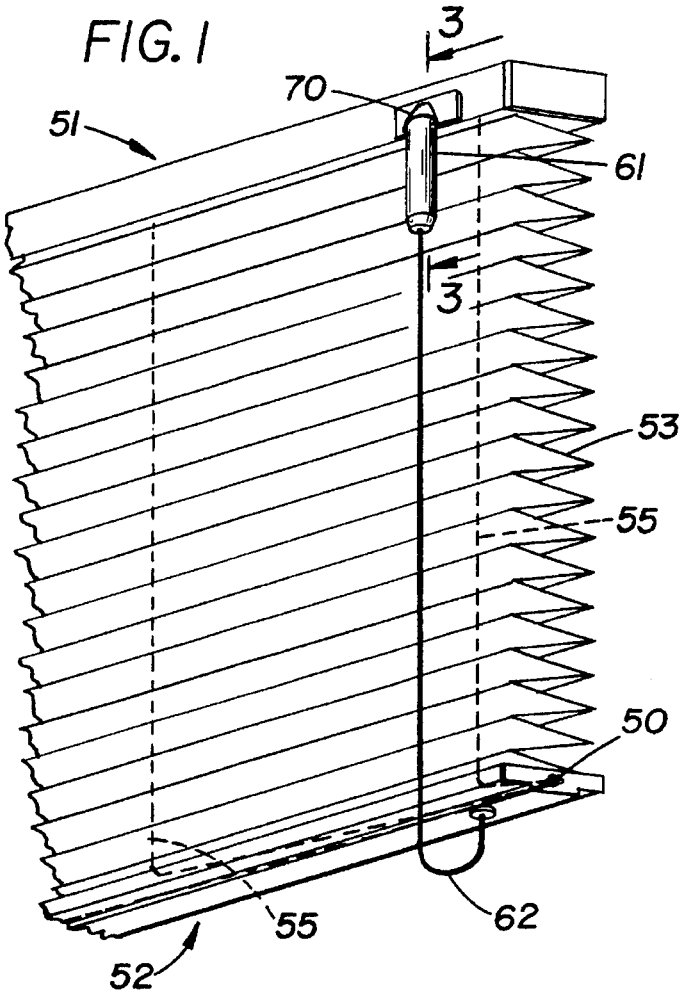
FIG. 1 is a fragmentary perspective view of a window shade in a lowered condition, with a cord connector applied thereto.
Figure 3:
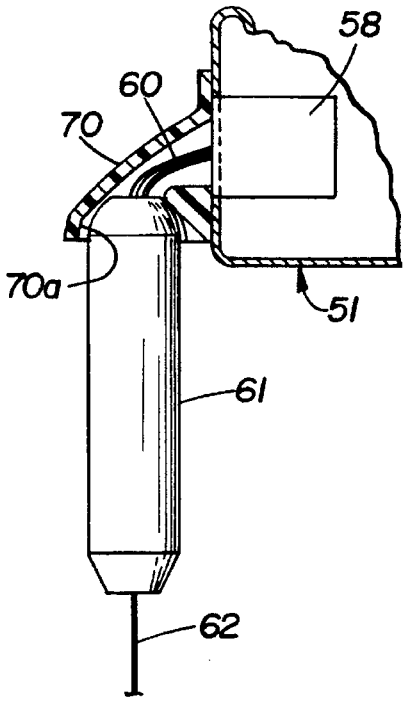
FIG. 3 is a fragmentary sectional view taken on the plane 3—3 of FIG. 1, and illustrating parts on a larger scale than in FIG. 1.
Figure 2:
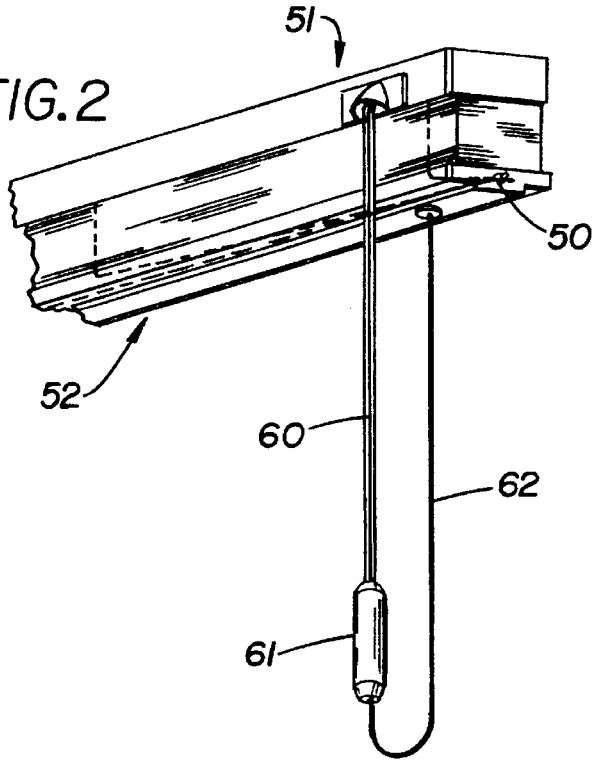
FIG. 2 is a fragmentary perspective view of the window shade of FIG. 1 in a raised condition.

Referring first to FIGS. 1–3 there is illustrated a window covering including a headrail 51, a bottom rail 52 and a window covering 53 that extends between the headrail and bottom rail. As used herein the phrase "window covering" is intended to include any window covering adapted to be extended or collapsed to cover and uncover a window opening, and which has two or more operating cords that must be operated together, for example expansible and contractable pleated shades as illustrated in FIG. 1; expansible and contractable cellular shades; venetian blinds; roman shades and the like. In general, such window coverings include two or more lift cords which are connected to a movable rail and extend upwardly through or alongside the window covering and into the headrail and then lengthwise through a headrail and through a cord lock 58 (FIG. 3) and terminate in a plurality of downwardly extending lift cord operating portions, hereinafter referred to as operating cords 60. A cord connector device 61 is provided for releasably connecting the multiple operating cords which may comprise from two to eight or more individual operating cords. The cord connector device 61 is adapted to normally hold the multiple operating cords for movement in unison and the user may grip the cord connector device and use it as a cord pull to raise and lower the window covering. It is also contemplated that a single pull cord such as shown at 62 in FIGS. 1–3 can be provided in some installations and arranged to extend downwardly from the cord connector device 61, to be gripped by the user for operating the blind when the cord connector is out of reach. A cord tassel can be provided on the lower end of the pull cord to facilitate manual operation of the pull cord or preferably, the lower end of the pull cord can be attached to the bottom rail so that the lower end of the pull cord will move upwardly with the bottom rail as the window covering is raised as shown in FIG. 2.

Referring now to FIGS. 5–10, there is illustrated a first embodiment of the releasable cord connector 61. In this embodiment, the cord connector has three side members 65 of like configuration and arranged in radial symmetry about a longitudinal axis. The side members are pivotally mounted at their lower ends on a base member 66 for movement between a closed condition in which the side members are in sidewise adjacent relation as shown in FIGS. 4–9 and an open condition in which the side members are laterally spaced apart above the hinges as shown in FIG. 10. The side members may be pivotally mounted in any suitable manner and, as best shown in FIGS. 4 and 9, the side members are formed with a blade portion 68 that pivotally receives a pivot pin 67 which may be formed on or mounted on the base member 66. The side members have an outer wall 69 with lengthwise extending side edges 69*a* that abut when the side members are in a closed condition, and inter-engaging latch means 71 and 72 on opposite side edges that are adapted to engage the latch means on adjacent side members to releasably retain the side members in a closed condition.

The cord connector has means for releasably retaining the operating cords on the cord connector at a location spaced above the hinged lower end of the side members. The operating cords 60 are provided with a cord stop 60*a* individual to each operating cord and having a cross-section larger than the cross-section of the operating cord. The cord stop 60*a* may, for example, comprise a knot on the lower ends of the operating cords as diagrammatically shown in FIGS. 4 and 9, or a bead or ferrule crimped on or otherwise secured to the operating cord, or an enlargement formed as by melting an end portion of the operating cord. In this embodiment, the cord retaining means comprises pie-shaped jaws 75 that extend inwardly from the outer walls 69 of the side members. When the side members are in the closed condition, the jaws provide downwardly facing shoulders at the underside thereof for engaging the cord stops 60*a* and the side edges 75*a* and 75*b* on adjacent jaws are spaced apart a distance substantially corresponding to the thickness of individual operating cords to receive and laterally confine the operating cords superjacent the cord stops to hold the stops in positions in which the cord stops engage the downwardly facing shoulders at the underside of the jaws. For example, a portion of one jaw edge 75*b* can be offset inwardly from a radial plane through the axis of symmetry, to form a shallow recess with the end face 75*a* on an adjacent jaw when the side members are in a closed condition. The recesses are preferably arranged to receive a plurality of operating cords and are preferably configured such that they do not provide an opening at the centerline that is larger than the cross-section of a cord abutment on an operating cord when the jaws are in a closed condition. The undersides of the jaws are preferably inclined upwardly and outwardly as shown in FIGS. 4 and 9, to encourage the cord stops to move away from the longitudinal centerline of the cord connector device and to facilitate assembly of the operating cords on the cord connector.

The side members 65 are formed with lateral cord abutment portions spaced above the cord retaining means and arranged to form segments of a closed loop dimensioned to loosely surround the operating cords at the upper end of the cord connector when the side members are in a closed condition. As shown in FIGS. 4, 5 and 9, the side members are formed with inwardly extending upper wall portions 78 at their upper ends with inner edges 80 that provide cord abutment portions configured to form segments of a closed cord abutment loop dimensioned to loosely surround the operating cords at the upper end of the cord connector. The size and the spacing of the cord abutment loop from the cord retention means is preferably selected such that the operating cords extend generally parallel to the lengthwise axis of the cord connector in the area between the cord retention means and the cord abutment loop. In normal use, the operating cords 60 extend upwardly through the closed loop and, when tensioned in a direction generally paralleling the lengthwise axis of the cord connector, do not apply lateral forces to the inner edges 80 on the side members sufficient to overcome deterents 71 and 72 and force the side members to an open condition. However, if the operating cords are separated and tensioned in opposite directions laterally outwardly of the cord abutment loop, such as would occur if an extremity or the head of a child became entangled between the operating cords at a location above the cord connector, the tensioned operating cords will apply forces having components directed laterally outwardly against the abutment edges 80 on the side members to urge the upper ends of the side members to an open condition. Since the operating cord retaining means provided by jaws 75 is spaced below the lateral cord abutment portions 78 a distance substantially greater than the cross-sectional dimension of the cord abutment loop, forces applied to the abutment portions in a direction laterally outwardly of the cord connector can actuate the side members to an open condition, substantially independent of the location at which operating cords are retained by the jaws. For example, the separating forces between two groups of operating cords can actuate the side members to an open condition, even when the operating cords may be crossed in the region between the cord retaining means and the cord abutment means as diagrammatically shown in FIG. 9.

Provision is preferably made for connecting a pull cord 62 to the lower end of the cord connector. As shown in FIGS. 4 and 9, base member 66 has a passage **66*a* extending centrally therethrough. The pull cord 62 can be directly connected to the base by arranging a cord stop 62*a* on the pull cord so that it engages the upper side of the base. However, it is preferable to increase the closing action of the side members when the pull cord 62 is tensioned downwardly. As shown, the side members are formed with upwardly converging bottom wall segments 81 and a disk member 82 having a conical underside overlies the segments 81. The pull cord is extended through an opening in the disk member 82 with a cord stop 62*a*** overlying the top of the member, and the underside of the disk member is shaped such that it contacts bottom wall segments adjacent the inner ends so that downward tension on the pull cord acts on the upwardly inclined bottom segments to urge the side members toward a closed condition.

A second embodiment of a releasable operating cord connector is illustrated in FIGS. 11–15. In this embodiment, the cord connector 161 comprises two side members 165 of like configuration and disposed on opposite sides of a parting line designated P and the side members are hingedly interconnected adjacent their lower ends as indicated at 168 for movement between a closed position in which the side members are in sidewise adjacent relation as shown in FIG. 11 and in open position as shown in FIG. 12 in which the side members are laterally spaced apart above the hinge. The side members are conveniently formed with an outer wall 169 having lengthwise extending side edges **169*a* that are adapted to abut each other when the side members are in a closed condition. Inter engaging latch means 171, 172 are provided for releasably retaining upper portions of the side members in a closed condition. As in the preceding embodiment, the operating cords are provided with individual operating cord stops 60*a* and the cord connector device has means for releasably retaining the operating cords at a location spaced above the hinge means and below the upper end of the cord connector. The cord retaining means comprises jaws 175 that extend inwardly from the associated side member and have inner edges disposed in opposed relation when the side members are in a closed condition. At least portions 175*a*, 175*b* of the opposed jaw edges are spaced apart a distance to accommodate the cross-section of individual ones of the cords therebetween as best shown in FIGS. 11 and 14, and are smaller than the cross-section of the cord stops on the operating cords. The edge portions 175*a*, 175*b* on the jaws 175 are adapted to have a plurality of operating cords disposed therebetween in sidewise adjacent relation and to laterally confine the operating cords to positions in which the cord stops 60*a* on the operating cords engage the downwardly facing shoulders formed by the underside of the jaws, when the side members are in a closed condition. The jaws 175** are operative when the side members are in the open condition to release lateral confinement of the operating cords and allow movement of the operating cords and cord stops thereon independent of the connector and independent of each other.

The side members 165 are provided with lateral cord abutment portions spaced above the cord retaining means and arranged to form segments of a closed cord abutment loop that is dimensioned to loosely surround the operating cords at the upper end of the cord connector when the side members are in the closed condition. More particularly, the side members are formed with inwardly extending wall portions 178 at their upper ends and inner edges **180*a*, 180*b* of the wall portions 178 are shaped to form segments of a closed cord abutment loop that is dimensioned to loosely receive the operating cords at the upper end of the cord connector. When the operating cords are tensioned at an angle to the lengthwise axis of the cord connector, the operating cords apply forces on the cord abutment loop segments 180*a* and 180*b* in a direction crosswise of the parting line plane P, which forces have a substantial component in a direction to separate the upper portions of the side members. However, when the lateral force is applied by the operating cords are in a direction generally paralleling the parting line plane P between the side members, one or more cords may enter between the adjacent edges of the side members when they start to separate and, further, the component of the lateral forces in a direction to separate the side members is reduced. Accordingly, the cord abutment portions on the two side members are advantageously configured to form a closed cord abutment loop having an oblong configuration with apexes 180***a*', 180*b*' at opposite sides of the parting line plane and side edges 180*a*" and 180*b*" that cross the parting line plane at an angle other than perpendicular to the parting line plane, for example as show in FIG. 13. This arrangement reduces the likelihood of an operating cord being drawn between adjacent edges of the side members. Further, when the lift cords are tensioned in opposite directions generally paralleling parting line plane, this cord abutment loop arrangement also guides the lift cords toward the apexes 180*a*' and 180*b*' at opposite sides of the parting line plane and this enhances separation of the upper portions of the side members.

The cord connector 161 is also adapted to have a pull cord 162 connected to the lower end thereof and the pull cord connection is arranged so that forces applied to the side members when the pull cord is tensioned, do not act in a direction to separate the side members and preferably act in a direction to aid in holding the side members in a closed condition. As best shown in FIGS. 11 and 12, the side members are formed with a bottom wall having upwardly and inwardly inclined portions 181, and a pressure applying member 182 is formed with a conical bottom wall arranged to engage the bottom wall portions 181 adjacent the inner ends thereof. The pull cord 62 has a stop 62*a* on the upper end and the pull cord extends downwardly through a central opening in the member 182 so that downward tension on the pull cord applies downward forces to the inner edges of the bottom wall portions 181 correlative with the tension in the pull cord 162. This urges the upper portions of the side members in a direction toward each other to aid in holding the side members in a closed condition when the pull cord is tensioned. Access openings 190 are conveniently provided in the side members 165, preferably below the jaws 175, to enable the operator to hold ends of the operating cords in each jaw member when assembling the operating cords on the jaws 175 while the connector is open. If it is deemed esthetically desirable, hinged covers (not shown) may be provided for hiding the openings 190.

A third embodiment of the releasable operating cord connector is illustrated in FIGS. 16–20. In this embodiment, the cord connector 261 has two side members 265 and a core member 270 disposed between the side members. The side members are preferably hingedly interconnected adjacent their lower ends, herein by an integral plastic hinge indicated at 268, and the side members are movable relative to each other about the hinge between a closed condition in which the side members have their edges 269*a* disposed in abutting relation at a parting line plane P as shown in FIG. 16, and an open condition in which the side members are laterally spaced apart above the hinge as shown in FIG. 17. Latch means 271, 272 are provided on the upper portions of the side members, to releasably hold the upper portions of the side members in a closed condition.

The core member 270 is disposed between the side members and, as shown in FIGS. 16 and 17, the core member has a base 273, adapted to rest on the bottom of the side members and a jaw portion 274 is spaced above the base. The side members have jaws 275 that extend inwardly from the outer wall at a location such that the jaws on the side members are disposed at opposite side edges of the jaw 274 on the core member, when the side members are in a closed condition as shown in FIGS. 16 and 19. When the side members are in the closed condition, the jaws 275 have edge portions 275*a* and 275*b* that are spaced from the jaw edge portions 274 and 274*b* on the jaw 274 a distance to accommodate the cross-section of an individual lift cord but less than the cross-section of the cord stop on the lift cord. The jaws 275 on the side members and the jaw member 274 on the core member, provide a downwardly facing shoulder at the underside and the edge portions 275*a* and 275*b* of the jaws on the side members laterally confine the operating cords superjacent the cord stops to positions in which the cord stops engage the downwardly facing shoulders on the jaws 275, when the side members are in the closed condition. As will be seen in FIG. 19, the horizontal width of the edge portion 275*a* and 275*b* of the jaws is sufficient to accommodate a plurality of lift cords in side-by-side relation.

The side members 265 have inwardly extending wall portions 278 adjacent their upper ends and the wall portions 278 have inner edges 280*a*, 280*b* that provide lateral cord abutment portions spaced above the jaws 275 and arranged to form segments of a closed cord abutment loop dimensioned to loosely surround the operating cords at the upper end of the cord connector when the side members are in the closed condition. As best shown in FIG. 18, the upper wall portions 278 abut each other at the parting line plane P in the region outwardly of the edge portions 280*a*, 280*b*. The edge portions 280*a*, 280*b* are preferably configured to form an oblong loop having apexes 280*a*' and 280*b*' at opposite sides of the parting line plane and side edges 280*a*" and 280*b*" that cross the parting line plane at an angle other than perpendicular to the parting line plane.

The cord connector is also conveniently adapted for connection to a pull cord 62. As shown in FIGS. 16 and 17, the base 273 of the core member has an opening therethrough and a lift cord 262 having a lift cord stop 262*a* can be inserted through the opening in the base member and through an opening or space 265*a* between the lower ends of the side members 265. As will be seen from FIG. 16, the base of the core member engages upwardly extending protrusions on the bottom of the side members, which protrusions are spaced inwardly a distance substantially less than the spacing between the inner edges 280*a* on the jaw members 275. Thus, when the pull cord is tensioned downwardly it applies a downward force on the side members at a location closely adjacent the parting line plane, and since the edge portions 280*a* and 280*b* of the jaws are spaced a greater distance from the parting line plane, the upward tension on the operating cords will have a component that tends to urge the upper portions of the jaws to the closed condition. If a pull cord is not used, any suitable means such as a fastener or a projection (not shown) on the bottom of the plug member can be provided for attaching the base 273 of the plug member in the opening 265*a*.

Figure 24:
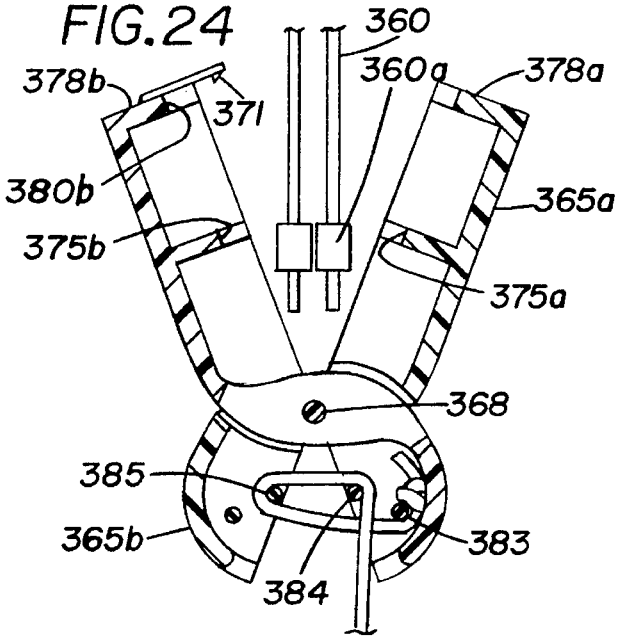
FIG. 24 is a longitudinal sectional view of the cord connector of FIG. 21 illustrating the connector in an open condition.
Figure 28:
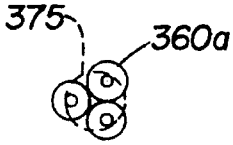
FIG. 28–31 are diagrammatic views illustrating cord stops for use with three, four, five and six operating cords in the embodiment of FIG. 21.

A fourth embodiment of the releasable operating cord connector is illustrated in FIGS. 21–31. In this embodiment, the cord connector 361 includes two side members 365 that are pivotally interconnected at 368, intermediate their upper and lower ends to form a tongs like device. The pivot supports the side members for pivotal movement relative to each other between a closed position in which the upper portions 365*a* of the side members are disposed in sidewise adjacent relation on opposite sides of a parting line plane P, and an open position in which the upper portions of the side members are laterally spaced apart as shown in FIG. 24. In this embodiment, the lower portions 365*b* of the side members move relative to the parting line plane in directions opposite the direction of movements of the upper portions.

Figure 25:
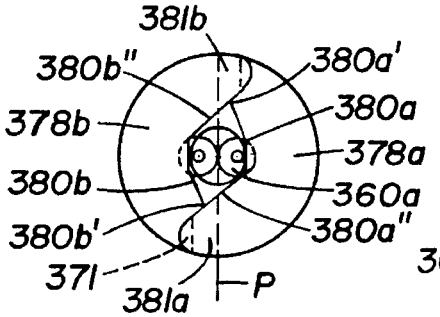
FIG. 25 is a top view of the cord connector shown in FIG. 21.
Figure 26:
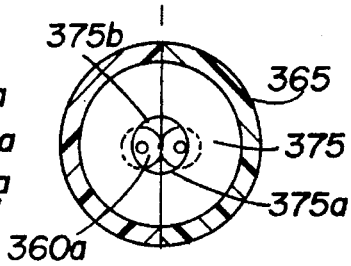
FIG. 26 is a transverse sectional view taken on the plane 26—26 of FIG. 22.
Figure 27:
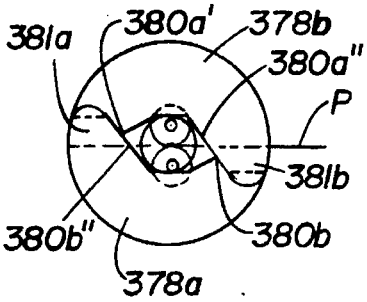
FIG. 27 is a top view of the cord connector as illustrated in FIG. 23.
Figure 21:
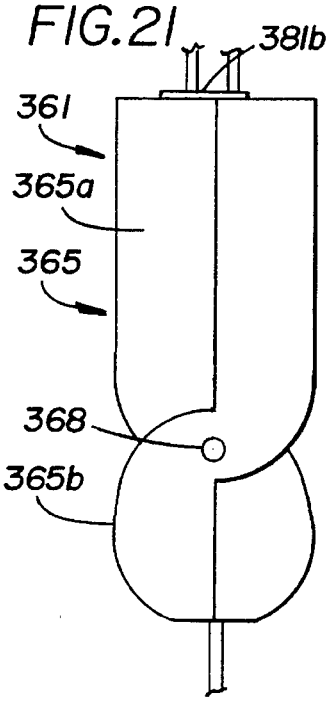
FIG. 21 is a side view of a fourth embodiment of the cord connector.
Figure 29:
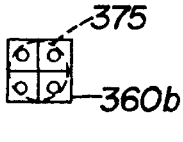
Figure 30:
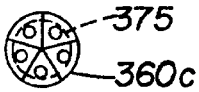
Figure 31:
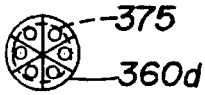

The side members 365 have inwardly extending jaws 375 spaced above the pivot 368 and, as best shown in FIG. 26, the jaws have edge portions 375*a* and 375*b* that are spaced apart to form a cord retaining means. In this embodiment, the edge portions 375*a* and 375*b* are shaped to form a circular cord abutment loop having a diameter larger than an individual cord stop and smaller than the effective cross-section of two or more cord stops, when the cord stops are in sidewise abutting relation. The size and shape of the cord stops provided at the lower ends of the operating cords 360 are selected in accordance with the number of operating cords, so that the cord stops will underlie the jaws 375 adjacent the edges 375*a*, 375*b* when the edges engage and laterally confine the operating cords superjacent the cord stops to positions in which the cord stops are in sidewise abutting relation and engage the downwardly facing shoulders on the underside of the jaws. Cord stops 360*a* of a size and shape suitable for use with two or more operating cords are illustrated in FIGS. 22–28 and cord stops 360*b* suitable for four operating cords; cord stops 360*c* for use with five operating cords; cord stops 360*d* for use with six operating cords are illustrated in FIGS. 29–31, respectively. Alternatively, it is deemed apparent that the jaws could be configured to provide a space therebetween corresponding to the thickness of a single operating cord with the space having a length sufficient to accommodate a multiplicity of cords, for example as shown in FIG. 14.

The upper portions 365*a* of the side members have upper wall portions 378*a* and 378*b* that extend inwardly and have inner edge portions 380*a* and 380*b* that form lateral cord abutments spaced above the jaws 375. The edge portions 380*a* and 380*b* are arranged to form segments of a closed cord abutment loop dimensioned to loosely surround the operating cords at the upper end of the cord connector. The edges 380*a* and 380*b* are preferably shaped as shown in FIG. 25 to form an oblong loop having apexes 380*a*' and 380*b*' disposed at relatively opposite sides of the parting line plane P, and side edges 380*a*" and 380*b*" that cross the parting line plane at an angle other than perpendicular to the parting line plane. The upper walls 378 also have wing portions 381*a* and 381*b* that extend latterly from the apexes 380*a*' and 380*b*' of the wall portions 378*a* and 378*b* respectively, in a direction to cross the parting line plane and form a continuation of side edges 380*a*" and 380*b*" to prevent operating cords from entering between the upper portions 365 of the side members when the side members begin to open. The wing portions 381*a* and 381*b* on the top walls 378*a* and 378*b* overlie a portion of the top walls 378*a* and 378*b* respectively on the other side member. A means such as detents 371, 372 are preferably provided on the wing portions 381*a* and 381*b* of the side members for releasably retaining the side members in a closed condition. As is deemed apparent, similar wing portions can be provided on the upper walls of the side members in the other embodiments.

Figure 22:
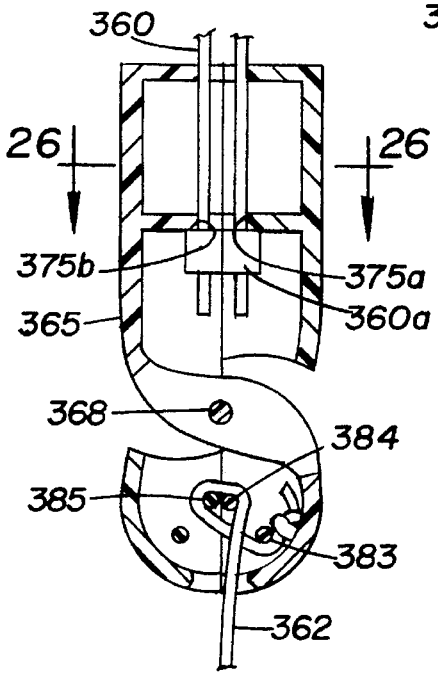
FIG. 22 is a longitudinal sectional view through the cord connector of FIG. 21.
Figure 23:
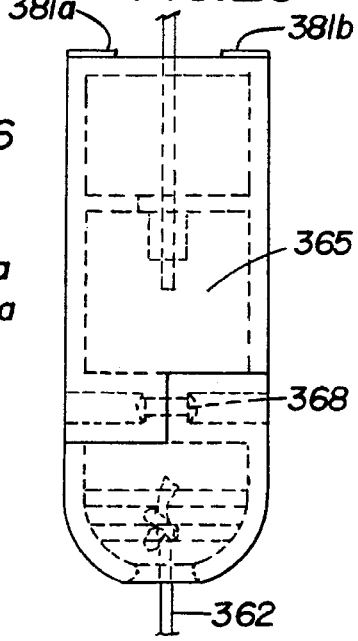
FIG. 23 is a side view of the cord connector of FIG. 21 on a plane at right angles to the plane of FIG. 21.

The cord connector 361 is also adapted for connection to a pull cord in a manner such that tension on the pull cord aids in holding the cord connector in a closed condition. As best shown in FIGS. 22 and 24, a pull cord 362 is attached to a lower portion of one side member at a location 383 below the pivot axis and is entrained over pins 384, 385 on the lower portions 365*b* of the side members, so that tension on the pull cord draws the lower portions 365*b* of the side members toward each other and accordingly urges the upper portions 365*a* of the side members into abutting relation with a force correlative with the tension in the pull cord.

In each of the embodiments, individual cord stops are provided on each of the operating cords and the cord connector engages and releasably retains the operating cords in positions such that they engage downwardly facing shoulders on the cord connector. While it is possible to arrange the cord stops on the operating cords at locations such that the tension on all operating cords are substantially equal when they are connected by the cord connector, means are advantageously provided for adjusting the ends of the lift cords that are connected to the bottom rail 52. This can be achieved by providing connectors on the bottom rail for adjustably connecting each lift cord to the bottom rail. In the form illustrated in FIGS. 1 and 2, the ends of the lift cords are extended to a connector indicated at 50 at an end of the bottom rail, so that the lift cords can be drawn to a taut condition when the bottom rail is in its fully lowered position, and the connector 50 then tightened to clamp the cords in the adjusted position. The clamp may, for example, be of the type shown in U.S. Pat. No. 4,753,281. In some window covering installations, particularly those having a large number of lift cords, it is also contemplated that connectors could be provided at both ends of the bottom rail with some of the lift cords connected together at one end of the bottom rail and others of the lift cords connected together at the opposite end of the bottom rail.

Although the cord connectors disclosed in each of the embodiments are adapted for connection at the lower end to pull cord 62, it is deemed apparent that the cord connector could be used as the pull tassel and that the pull cord could be omitted. Further, when a pull cord is connected to the cord connector, it can be provided with a pull tassel (not shown) at a lower end of the pull cord to operate a window covering, or the pull can be connected to the bottom rail as shown in FIGS. 1 and 2. In installations where the pull cord is connected to the bottom rail, it is preferable to use a releasable connection between the pull cord and bottom rail to open the loop formed by the pull cord if a child becomes entangled in the pull cord loop.

In some installations such as shown in U.S. Pat. No. 5,058,650, a cord equalizer is arranged to engage a stop on the headrail such as the cord lock, to stop downward movement of the bottom rail at a preselected level such as when the bottom rail is adjacent the window sill. In order to minimize likelihood of opening of the operating cord connector due to impact with a stop on the headrail, the cord connector is preferably formed with an inwardly tapered or inwardly rounded upper end, for example as shown in the embodiments designated 1–4, and a stop member 70 is mounted on the headrail and configured to provide a downwardly opening passage 70*a* around the operating cords as shown in FIG. 1, the passage being shaped to receive the upper end of the cord connector to aid in holding the side members of the cord connector in closed condition when the upper end of the cord connector enters the passage.

The embodiments of the invention in which an exclusive property or privilege is claimed are defined as follows:

1. In combination with a window covering having operating cords for operating the window covering, means providing individual cord stops on a plurality of the operating cords adjacent the ends thereof, a cord connector device for releasably connecting the plurality of operating cords for movement together, the cord connector device having upper and lower ends and at least two side members, hinge means supporting the side members for pivotal movement relative to each other about axes spaced below the upper end of the cord connector device between a closed condition in which upper portions of the side members are in sidewise adjacent relation and an open condition in which upper portions of the side members are laterally spaced apart, means for releasably holding the upper portions of the side members in the closed condition, the cord connector device having means for releasably retaining the plurality of operating cords on the cord connector device at a location spaced below the upper end and above the hinge means, the cord retaining means including means providing downwardly facing shoulder means for engaging the cord stops on the plurality of operating cords and operative when the side members are in closed condition for laterally confining portions of the operating cords superjacent the cord stops to positions in which the cord stops engage the downwardly facing shoulder means, the cord retaining means being operative when the side members are in the open condition to release lateral confinement of the portions of the operating cords superjacent the cord stops and allow movement of the plurality of operating cords and the cord stops thereon independent of the connector device and independent of each other, the side members having lateral cord abutment portions thereon spaced above the cord retaining means and, arranged to form segments of a closed cord abutment loop dimensioned to loosely surround the plurality of operating cords at the upper end of the cord connector device when the side members are in closed condition, the side members being so configured that portions of the side members below the cord abutment means and above the cord retaining means do not engage the plurality of operating cords when the side members are in the closed condition, the means for holding the upper portions of the side members in the closed condition being constructed and arranged to release and allow the side members to move to the open condition in response to the application of forces by different ones of the operating cords concurrently to different ones of the cord abutment portions in directions laterally outwardly of the loop.

2. A combination according to claim 1 wherein the hinge means supports the side members for pivotal movement about axes below the cord retaining means and adjacent the lower end of the cord connector device.

3. A cord connector device for releasably connecting a plurality of operating cords in a window covering, the cord connector device having upper and lower ends and at least two side members, hinge means supporting the side members for pivotal movement relative to each other about axes spaced below the upper end of the cord connector device between a closed condition in which upper portions of the side members are in sidewise adjacent relation and an open condition in which the upper portions of the side members are laterally spaced apart, means for releasably holding the upper portions of the side members in a closed condition, the cord connector device having means for releasably retaining the operating cords on the cord connector device at a location spaced above the hinge means, the cord retaining means including means providing downwardly facing shoulder means for engaging cord stops on the operating cords and means operative when the side members are in the closed condition for laterally confining portions of the operating cords superjacent the cord stops to positions in which the cord stops engage the downwardly facing shoulder means, the cord retaining means being operative when the side members are in the open condition to release lateral confinement of the portions of the operating cords superjacent the cord stops and allow movement of the operating cords and the cord stops thereon independent of the connector device and independent of each other, the means for holding the upper portions of the side members in the closed condition being constructed and arranged to release and allow the side members to move to the open condition in response to forces acting on the upper end of the cord connector device in a direction laterally outwardly the side members, a pull cord, and pull cord attachment means for connecting one end of the pull cord to the lower end of the cord connector device.

4. A combination according to claim 3 wherein the pull cord attachment means includes means responsive to downward tension on the pull cord for applying forces to the side members at locations and in directions to aid in holding the upper portions of the side members in the closed condition.

5. A combination according to claim 3 including means for connecting a second end of the pull cord to a movable rail on the window covering.

6. A combination according to claim 1 wherein the shoulder means includes a jaw extending inwardly from each of the side members and providing a downwardly facing shoulder at the underside thereof, the jaws having jaw edges disposed in opposed relation when the side members are in the closed condition, at least portions of the opposed jaw edges being spaced apart a distance to accommodate the cross-section of individual one of the operating cords therebetween and smaller than the cross-section of the cord stop on the operating cord.

7. A combination according to claim 6 wherein the cord connector device has two side members only.

8. A combination according to claim 1 wherein the cord connector device has two side members only and a core member between the two side members, the shoulder means comprising a jaw extending inwardly from each of the side members and providing a downwardly facing shoulder at the underside thereof, each jaw having an edge disposed at a respective side of the core member when the side members are in the closed condition and each jaw having at least portions of the jaw edge spaced from the core member a distance to accommodate the cross-section of an individual operating cord but less than the cross-section of the cord stop on the operating cord.

9. A combination according to claim 1 wherein the cord connector device has at least three side members.

10. A combination according to claim 1 wherein the cord connector device has three side members arranged in radial symmetry about a longitudinal axis.

11. A cord connector device for releasably connecting a plurality of operating cords in a window covering, the cord connector device having upper and lower ends and at least two side members, hinge means supporting the side members for pivotal movement relative to each other about axes spaced below the upper end of the cord connector device between a closed condition in which upper portions of the side members are in sidewise adjacent relation and an open condition in which the upper portions of the side members are laterally spaced apart, means for releasably holding the upper portions of the side members in a closed condition, the cord connector device having means for releasably retaining the operating cords on the cord connector device at a location spaced above the hinge means, the cord retaining means including means providing downwardly facing shoulder means for engaging cord stops on the operating cords and means operative when the side members are in the closed condition for laterally confining portions of the operating cords superjacent the cord stops to positions in which the cord stops engage the downwardly facing shoulder means, the cord retaining means being operative when the side members are in open condition to release lateral confinement of the portions of the operating cords superjacent the cord stops and allow movement of the operating cords and cord stops thereon independent of connector device and independent of each other, the means for holding the upper portions of the side members in the closed condition being constructed and arranged to release and allow the side members to move to the open condition in response to forces acting on the upper end of the cord connector device in a direction laterally outwardly the side members, the cord connector device having three side members arranged in radial symmetry about longitudinal axis, a base member at the lower end of the cord connector device, said hinge means swingably mounting lower portions of the side members on the base member for movement of the upper portions of the side members in paths generally radially of the longitudinal axis.

12. A combination according to claim 11 wherein the shoulder means comprises a jaw extending inwardly from each side member and providing a downwardly facing shoulder at an underside thereof, the jaws having jaw edges disposed in opposed relation to each other when the side members are in the closed condition, portions of the jaw edges being spaced apart to define an opening having a size that allows passage of the operating cords therethrough while preventing upward passage of the cord stops on the operating cords therethrough.

13. A cord connector device for releasably connecting a plurality of operating cords in a window covering, the cord connector device having upper and lower ends and at least two side members, hinge means supporting the side members for pivotal movement relative to each other about axes spaced below the upper end of the cord connector device between a closed condition in which upper portions of the side members are in sidewise adjacent relation and an open condition in which the upper portions of the side members are laterally spaced apart, means of releasably holding the upper portions of the side members in a closed condition, the cord connector device having means for releasably retaining the operating cords on the cord connector device at a location spaced above the hinge means, the cord retaining means including means providing downwardly facing shoulder means for engaging the cord stops and means operative when the side members are in closed condition for laterally confining portions of the operating cords superjacent the cord stops to positions in which the cord stops engage the downwardly facing shoulder means, the cord retaining means being operative when the side members are in open condition to release lateral confinement of the portions of the operating cords superjacent the cord stops and allow movement of the operating cords and the cord stops thereon independent of the connector device and independent of each other, the means for holding the upper portions of side members in the closed condition being constructed and arranged to release and allow the side member to move to the open condition in response to forces acting on the upper end of the connector device in a direction laterally outwardly the side members, the cord connector device including two side members only, the hinge means interconnecting the side members at a location spaced below the operating cord retaining means, the side members having lower portions below the hinge means, the lower portions of the side members being disposed in sidewise adjacent relation when the side members are in the closed condition and being laterally spaced apart when the side members are in open condition, a pull cord attached to the lower portions of the side members in a manner to draw the lower portions toward each other when the pull cord is tensioned downwardly.

14. In combination with a window covering having a headrail and operating cords extending downwardly of the headrail, means providing individual cord stops on a plurality of the operating cords, a cord connector device for releasably connecting the plurality of operating cords for movement together, the cord connector device having upper and lower ends and at least two side members, the side members being movable relative to each other between a closed condition in which upper portions of the side members are in sidewise adjacent relation and an open condition in which the upper portions of the side members are laterally spaced apart, means for releasably holding the upper portions of the side members in a closed condition, the cord connector device having means spaced below the upper end thereof for releasably retaining the plurality of operating cords on the cord connector device, the cord retaining means including means spaced below the upper end of the cord connector device providing downwardly facing shoulder means for engaging the cord stops on the plurality of operating cords and operative when the side members are in the closed condition for laterally confining portions of the plurality of operating cords superjacent the stops to positions in which the cord stops engage the downwardly facing shoulder means, the cord retaining means being operative when the side members are in open condition to release lateral confinement of the portions of the plurality of operating cords superjacent the cord stops and allow movement of the plurality of operating cords and the cord stops thereon independent of the cord connector device and independent of each other, the side members having lateral cord abutment portions thereon spaced above the cord retaining means and, arranged to form segments of a closed cord abutment loop dimensioned to loosely surround the plurality of operating cords adjacent the upper end of the cord connector device, the side members being so configured that portions of the side members below the cord abutment means and above the cord retaining means do not engage the operating cords when the cord connector device is closed, the means for holding the upper portions of the side members in the closed condition being constructed and arranged to release and allow the side members to move to open condition in response to the application of forces by different ones of the plurality of operating cords concurrently to two different ones of the cord abutment portions in directions laterally outwardly the loop.

15. A combination according to claim 14 wherein cord connector device has two side members only, the shoulder means comprising a jaw extending inwardly from each of the side members and providing a downwardly facing shoulder at the underside thereof, the jaws having jaw edges disposed in opposing relation when the side members are in the closed condition, at least portions of the opposed jaw edges being spaced apart a distance to accommodate the cross-sections of individual ones of the operating cords therebetween and smaller than the cross-sections of a cord stop on the operating cord.

16. A combination according to claim 14 wherein the cord connector device has two side members only and a core member between the two side members, the shoulder means including a jaw extending inwardly from each of the side members and providing a downwardly facing shoulder at the underside thereof, each jaw having an edge disposed at a respective side of the core member when the side members are in the closed condition and each jaw having at least portions of the jaw edge spaced from the core member a distance to accommodate the cross-section of an individual lift cord but less than the cross-section of the cord stop on the lift cord.

17. A combination according to claim 14 wherein the cord connector device has two side members only with the cord abutment portions on the two side members disposed on opposite sides of a parting line plane when the side members are in the closed condition, the cord abutment portions being configured to form a closed cord abutment loop having opposite side edges that cross the parting line plane at other than a right angle.

18. A combination according to claim 14 wherein the cord connector device has three side members arrange in radial symmetry about a longitudinal axis.

19. A combination according to claim 14 wherein the cord connector device has three side members arranged in radial symmetry about a longitudinal axis, a base member at the lower end of the cord connector device, said hinge means swingably mounting lower portions of the side members on the base member for movement of the upper portions of the side members in paths generally radially of the longitudinal axis.

20. A combination according to claim 14 including hinge means adjacent the lower end of the cord connector device supporting the side members for pivotal movement relative to each other between the open and the closed conditions.

21. A combination according to claim 14 wherein the cord connector device includes three side members, the shoulder means including a jaw extending inwardly from each side member and providing a downwardly facing shoulder at an underside thereof, the jaws having jaw edges disposed in opposed relation to each other when the side members are in closed condition, portions of the jaw edges being spaced apart to define an opening having a size that allows passage of the operating cords upwardly therethrough while preventing upward passage of the cord stops on the operating cords therethrough.

22. A combination according to claim 14 including hinge means interconnecting the side members at locations spaced below the operating cord retaining means.

23. A combination according to claim 14 including hinge means interconnecting the side members below the operating cord retaining means, the side members having lower portions below the pivot means, the lower portions of the side members being disposed in sidewise adjacent relation when the side members are in the closed condition and being laterally spaced apart when the side members are in the open condition, a pull cord attached to the lower portions of the side members in a manner to draw the lower portions toward each other when the pull cord is tensioned downwardly.

24. A combination according to claim 14 including connector stop means adapted for mounting on the headrail, the connector stop providing a downwardly opening passage means around the operating cords, the downwardly opening passage means being shaped to receive the upper ene of the cord connector to aid in holding the cord connector in the closed condition when the upper end of the cord connector enters the passage means.

25. A combination according to claim 14 wherein each cord stop comprises a knot in the operating cord.

26. A combination according to claim 14 wherein the cord stops comprise an individual member affixed to each operating cord and having a cross-section larger than the cross-section of the operating cord.

27. A combination according to claim 26 wherein the shoulder means includes a jaw extending inwardly from each of the side members and providing a downwardly facing shoulder at the underside thereof, the jaw having edges disposed in opposed relation when the side members are in the closed condition, portions of the opposed jaw edges being spaced apart ot provide an opening larger than the cross-section of an individual cord stop member but smaller than the effective cross-section of two or more cord stop members in sidewise adjacent relation.

28. A combination according to claim 14 wherein the cord connector device has two side members disposed on opposite sides of a parting line plane when the side members are in a closed condition and said closed cord abutment loop intersects the parting line plane at two locations, each side member having a wing portion that extends from a respective one of said locations and across the parting line plane and overlaps a portion of the other side members for inhibiting passage of the operating cords from the cord abutment loop and between the side members at the parting line plane.

29. A combination according to claim 28 wherein said means for holding the side members in a closed condition includes detents on the wing portions.

30. A cord connector device for connecting a plurality of operating cords in a window covering comprising, a body having upper and lower ends and at least two side members, the side members being movable relative to each other between a closed condition in which the side members are in sidewise adjacent relation and an open condition in which at least the upper portions of the side members are latterly spaced apart, means for releasably holding the side members in a closed condition, the cord connector device having means spaced below the upper end thereof for releasably retaining at least some of the operating cords on the cord connector device, means providing cord stops on said some operating cords, the cord retaining means including means spaced below the upper end of the cord connector device providing downwardly facing shoulder means for engaging the cord stop and means operative when the side members are in closed condition for laterally confining portions of said some operating cords superjacent the stops to positions in which the cord stops engage the downwardly facing shoulder means, the cord retaining means being operative when the side members are in the open condition to release lateral confinement of the portions of the operating cords superjacent the cord stops and allow movement of the operating cords and the cord stops thereon independent of the cord connector device and independent of each other, the side members having lateral cord abutment portions extending inwardly from the side members and spaced above the cord retaining means and arranged to form segments of a closed cord abutment loop dimensioned to loosely surround said some operating cords adjacent the upper end of the cord connector device, the means for holding the side members in the closed condition being constructed and arranged to release and allow the side members to move to the open condition in response to forces acting on the cord abutment portions in a direction laterally outwardly the loop, the side members being so configured that, when the side members are in the closed condition, the cord connector device defines an internal cavity between the cord abutment loop and the cord retaining means having a cross-section larger than the abutment loop.

31. A cord connector device according to claim 30 wherein the cord connector device has three sides members, a base member at the lower end of the body, and hinge means mounting lower portions of the side members on the base member for movement of the upper portions of the side members in paths generally radially of the longitudinal axis.

* * * * *